US007160363B2

(12) United States Patent
Kulmala et al.

(10) Patent No.: US 7,160,363 B2
(45) Date of Patent: Jan. 9, 2007

(54) ELECTROSTATIC FILTER CONSTRUCTION

(75) Inventors: Ilpo Kulmala, Tampere (FI); Kimmo Heinonen, Tampere (FI)

(73) Assignee: Oy Lifa Iaq Ltd., Helsinki (FI)

( * ) Notice: Subject to any disclaimer, the term of this patent is extended or adjusted under 35 U.S.C. 154(b) by 152 days.

(21) Appl. No.: 10/510,404

(22) PCT Filed: Apr. 10, 2003

(86) PCT No.: PCT/FI03/00272

§ 371 (c)(1),
(2), (4) Date: Nov. 8, 2004

(87) PCT Pub. No.: WO03/084665

PCT Pub. Date: Oct. 16, 2003

(65) Prior Publication Data

US 2005/0223899 A1 Oct. 13, 2005

(30) Foreign Application Priority Data

Apr. 11, 2002 (FI) ..... 20020700

(51) Int. Cl.
*B03C 3/155* (2006.01)

(52) U.S. Cl. ..... 96/67; 96/68; 96/84; 96/88

(58) Field of Classification Search ..... 96/65–70, 96/84, 88, 99

See application file for complete search history.

(56) References Cited

U.S. PATENT DOCUMENTS 2,888,092 A * 5/1959 Powers ..... 96/67
3,073,094 A * 1/1963 Landgraf et al. ..... 96/66
3,973,932 A * 8/1976 Alskog ..... 96/67
4,509,958 A * 4/1985 Masuda et al. ..... 96/60
4,750,921 A * 6/1988 Sugita et al. ..... 96/67
4,781,736 A * 11/1988 Cheney et al. ..... 96/60
4,940,470 A * 7/1990 Jaisinghani et al. ..... 95/78
4,978,372 A * 12/1990 Pick ..... 96/67
5,097,665 A * 3/1992 Kammel ..... 60/275
5,108,470 A * 4/1992 Pick ..... 96/58
5,330,559 A * 7/1994 Cheney et al. ..... 95/63
5,403,383 A * 4/1995 Jaisinghani ..... 95/69
5,474,599 A * 12/1995 Cheney et al. ..... 96/55
5,540,761 A * 7/1996 Yamamoto ..... 96/67
5,549,735 A 8/1996 Coppom ..... 96/63
5,807,425 A * 9/1998 Gibbs ..... 96/66
5,846,302 A * 12/1998 Putro ..... 96/66
5,961,693 A * 10/1999 Altman et al. ..... 95/78
6,491,743 B1 * 12/2002 Joannou et al. ..... 96/67

(Continued)

FOREIGN PATENT DOCUMENTS

JP 61-209061 * 9/1986 ..... 96/67

(Continued)

*Primary Examiner*—Richard L. Chiesa
(74) *Attorney, Agent, or Firm*—Smith-Hill and Bedell

(57) ABSTRACT

This publication discloses an electrostatic filter construction, which includes electrodes connected to a first electrical potential, second electrodes, which are electrically insulated from the first electrodes, and an insulating material acting as a particle filter, which is located between the first and the second electrodes. According to the invention, in both of the electrodes the electrode material used is a material, such as activated carbon, which is permeable to a gas and which filters the gas, and which has a low electrical conductivity, and both electrodes are located essentially parallel to the direction of the airflow.

8 Claims, 4 Drawing Sheets

U.S. PATENT DOCUMENTS

| | | | | |
|---|---|---|---|---|
| 6,635,106 | B1 * | 10/2003 | Katou et al. | 96/67 |
| 6,749,669 | B1 * | 6/2004 | Griffiths et al. | 96/67 |
| 2002/0170435 | A1 * | 11/2002 | Joannou | 96/66 |

FOREIGN PATENT DOCUMENTS

| | | |
|---|---|---|
| WO | 98/22222 | 5/1998 |

* cited by examiner

ELECTROSTATIC FILTER CONSTRUCTION

This is a national stage application filed under 35 USC 371 based on International Application No. PCT/FI2003/00272 filed Apr. 10, 2003, and claims priority under 35 USC 119 of Finnish Patent Application No. 20020700 filed Apr. 11, 2002.

The present invention relates to an electrostatic filter construction gas and particle filter.

Consciousness of air impurities and the health hazards caused by them has increased considerably in recent years. Research has shown that gaseous and particulate impurities are environmental exposure agents that clearly increase sickness and health hazards. The problems are worst in large cities, in which emissions from traffic and energy production pollute the air. Besides their health hazards, impurities in outdoor air also affect the corrosion and oxidation of materials.

Attempts are made to reduce the impurities travelling from outside to the indoor air of buildings and vehicles by filtering the incoming air. Nowadays, the replacement air for dwellings, offices, and commercial buildings is cleaned using only particle filters; gases are filtered mainly only in special cases (e.g., clean rooms, electrical and electronics rooms).

The separation ability of particle filters varies greatly depending on the size of the particles. Fibre filters separate particles well if they are more than 5 μm, such as, for example, pollens. However, most of the emissions from traffic and energy production are small particles (particle size less than 1 μm), which are much more difficult to filter.

One effective way to filter small particles is the electrostatic precipitator shown in FIG. 1, the operation of which is based on an electrically charged particle and the force exerted by an electrical field on the particle. In conventional two-stage electrostatic precipitators used in air-conditioning applications, the airflow and the particles in it are first led through a charger section 1, in which they are charged electrically. The figure shows the corona wires 4 and the path 3 of the ions. After this, the airflow travels to a collector section 2, which is formed of alternating collector 9 and high-voltage electrodes 15, according to FIG. 1. The figure shows the path of a positively charged particle 5 from the filter. The corona voltage value is typically +8 kV and the collector plate value +4 kV. The distance between the plates is typically in the order of 5 mm, so that a normally sized cell contains about 100 plates. Drawbacks with an electrostatic precipitator are the complexity of the solution and its subsequent expensiveness. At the same time, the dust collecting on the collector plates can cause spark-overs, which lead to the production of unhealthy ozone, an unpleasant sound, and a temporary weakening of the filtering efficiency.

According to FIG. 2, electrostatic precipitation can also be applied to a fibre filter. The particles are charge in the same way as in the electrostatic precipitator, but the collection section 2 is formed of a fibre filter 7, above which a power electrical field is arranged with the aid of a metal mesh 7. This solution too does not eliminate the ozone production problem. The metal mesh 7 has no filtering properties.

Recently, combination filters have appeared on the market, which filter gases and particles. However, the small-particle separation efficiency of combination filters is quite modest (they generally belong to the filter class EU6 –EU7, which means, for example, that they filter a half or less of the 0.3 μm particles) . The ability of the filters to charge gases is very modest in relation to the nominal airflow. U.S. Pat. No. 5,108,470 (Charging element having odour and gas absorbing properties for an electrostatic air filter) discloses a filter, in which a flat electrode containing activated carbon is located between two filter structures. The activated-carbon electrode is connected to an electrical power circuit. The construction is surrounded by metal electrodes, which have no filtering properties. The filter construction is at right angles to the direction of flow.

Application WO 98/22222 (Device in connection with an electrostatic filter) in turn discloses placing a fibre filter between two or more activated-carbon electrodes. In this case, the direction of the flow is at right angles to the electrodes.

A general problem with flat-plate filter solutions is the small amount of gas filtering material: for the filter to be able to effectively separate gaseous impurities, the transit time through the filter material should be sufficiently long. The small amount of adsorptive material means that the charging capacity of the solutions described for gaseous impurities remains low. For this reason, the filters have a short service life. By adding consecutive filtering stages, the gas filtering ability of the alternatives referred to above can be increased, but at the same time the pressure drop will increase.

The capacity of a gas filter can be increased by using a corrugated construction, as disclosed in patent U.S. Pat. No. 5,549,735 (Electrostatic fibrous filter). The patent discloses a solution, in which there is a charger section, a high-voltage electrode with the same polarity as the charger section, and an earthed activated carbon electrode. The high voltage is used to form an electrical field between the metal mesh and the activated carbon electrode.

The metal mesh does not have filtering properties. It is difficult to make an even electrical field, because close to the tops of the corrugations the distance of the electrodes easily differs from what it is in the flat section. When making the creases, the upper and lower parts of the corrugations must be sealed. In addition, the parts must be impermeable to air, because the upper and lower parts do not participate in filtering.

To produce clean incoming air, a filter must be able to filter not only small particles, but also gaseous impurities. One problem is the pressure drop over the filter: present solutions cannot provide effective particle and gas filtering simultaneously with a low pressure drop. Effective filtering is also expensive to implement. In practice, this means that existing air-conditioning machinery would require more powerful and also noisier fans, in order to compensate for the pressure drop caused by the additional filtering. An increasing pressure drop over the filter will require a corresponding increase in fan energy, thus correspondingly increasing the power consumption of the fans.

The invention is to create an entirely new type of particle filter, with the aid of which the drawbacks of the prior art referred to above can be eliminated.

The invention is based on the fact that at least one of the filter's electrodes is formed of an air-permeable, typically porous material with a poor electrical conductivity, such as activated carbon, in the form of a bag. In addition, both electrodes are positioned substantially parallel to the direction of flow of the gas.

Considerable advantages are gained with the aid of the invention.

With the aid of this invention, air (or some other gas) is cleaned effectively of both gaseous and particulate impurities. The construction also permits a solution with a low pressure drop. For this reason, the filter can be installed in existing ventilation systems, without changes being required in the fans. In addition to having low operating costs, the solution is also economical to implement.

The benefits of the solutions are:

effective combined gas and particle filtering, a long service life, if used as a filter for individual rooms, a low pressure drop and thus low energy costs, control of the production of the deleterious ozone that appears in electrostatic filters: the gas filter removes the ozone that arises in the corona discharge, elimination of the need for filter-cell cleaning that arises in electrostatic filters: dirtied filters are changed frequently, manufacture of the construction is simple and economical, the used replaceable component can be manufactured from materials that can be disposed of by e.g. burning, the fibre filter also acts as the insulating material for the electrodes, the carbon-fibre electrodes can be preferably manufactured, for example, by sewing, making the replaceable filter components particularly cheap to manufacture.

The changing of the filter also eliminates the typical problem of electrostatic filters, i.e. the cleaning of dirt collected on the filter cells. Collected dirt is often difficult to clean, it can corrode the collector electrodes and causes spark-over between the collector and voltage electrode. This in turn causes ozone production, weakening in the collection efficiency, and an unpleasant sound. Nowadays, unreliability is indeed one of the biggest problems relating to electrostatic filtering.

In the following, the invention is examined with the aid of examples and with reference to the accompanying drawings.

Figure 1:
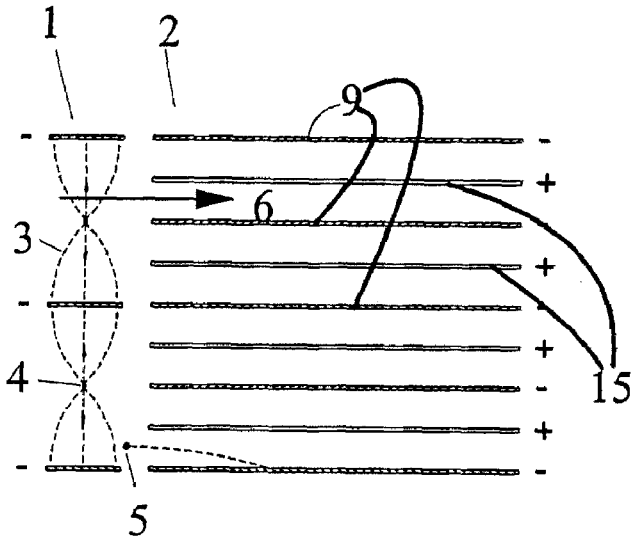
Fig. 1 PRIOR ART
FIG. 1 shows a schematic diagram of one filter solution according to the prior art.
Figure 2:
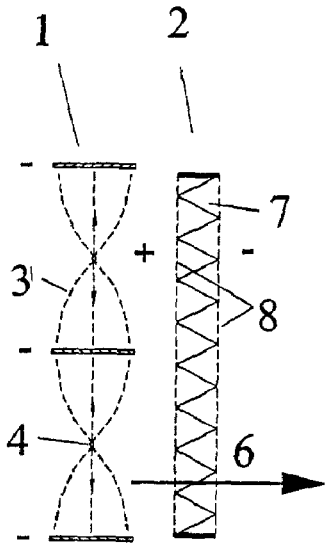
Fig. 2 PRIOR ART
FIG. 2 shows a schematic diagram of a second filter according to the prior art.
Figure 3:
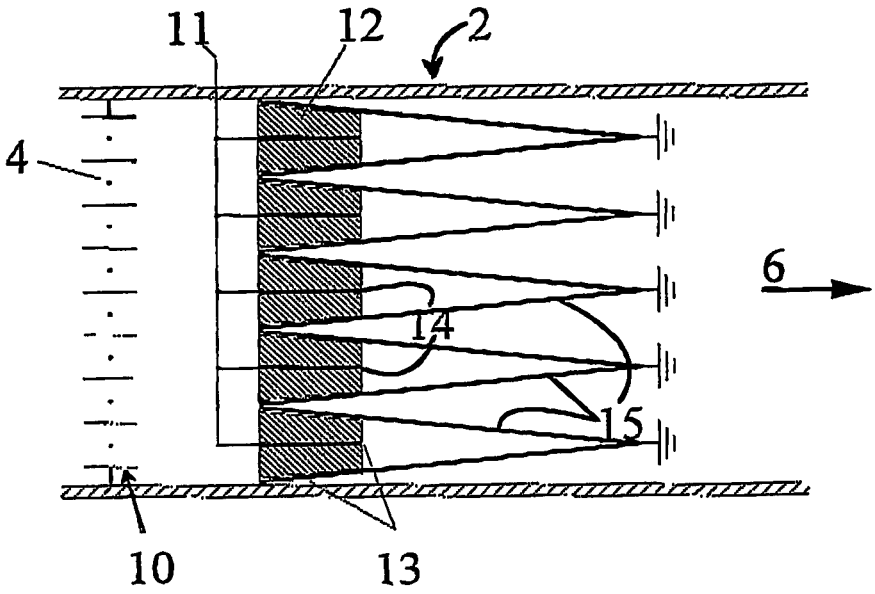
FIG. 3 shows a schematic diagram of the filter solution according to the invention.

In the following, the invention is examined with the aid of the following terms:

1 charging section
2 separation section, electrostatic filter
3 ion path
4 corona wire
5 positive charge
6 air flow
7 fibre filter
8 metal mesh
9 separation plate
10 charging unit
11 high voltage
12 fibre filter
13 activated carbon filter
14 positive electrode of the activated carbon filter
15 earthed electrode of the activated carbon filter FIG. 3 shows a solution according to the invention. In the filter, electrical forces are exploited by charging the particles with the aid of a corona discharge produced, for example, using corona wires 4, and collected with the aid of an electrical field in a collector unit 2. In the charger unit 10 and the collector unit 2, voltages of the order of 8–10 kV can be used. With the aid of the electrical forces, effective filtering can be achieved for small particles too, without high pressure drops.

A new feature in the filter is that both electrodes 14 and 15 are manufactured from activated carbon, or some other material containing a substance that filters gases, and which has a low electrical conductivity. In this case, a material with a low electrical conductivity refers to a material with a surface resistance in the order of $10^9$–$10^{15}$ Ohms.

The electrodes 14 and 15 are thus typically of a porous material. One material of the electrode 14 can be, for example, a porous polymer with low electrical conductivity. Between the electrodes 14 and 15 a rough filter material (fibre filter) 12 is placed, which is economical and which has a low pressure drop. Other materials permeable to air can also be used as the filter material, provided they are sufficiently porous. The fibre filter 12 also acts as a separator between the high-voltage electrodes 14 and the earthed electrodes 15, to prevent spark-overs.

According to FIG. 3, the electrode constructions 15 are preferably positioned to form bag-like pockets, through which the gas being filtered must travel. The fibre filter 12 and the electrode 14 are placed inside the bag-like electrode 15, in such a way that the electrodes 14 and 15 are more or less parallel. The maximum depth of the fibre filter 12 in the direction of flow of the air can be the same as the depth of the pocket formed by the bag-like electrode 15.

The electrodes 14 and 15 are positioned substantially according to the direction of flow of the gas. According to the invention, this means that the angle of the electrodes 14 and 15 relative to the direction of flow is no greater than 45°. When examining the angle, the effective area of the electrodes must be taken into consideration. In the small fold areas of the electrodes 14 and 15, which account for a few percent of the flow, the angle of the electrodes may deviate from the limit value stated above.

To make the point clear, transverse filters, which do not come within the scope of the invention, are typically at an angle of 90° to the direction of flow.

In order to bring the electrical filtering effect to a sufficient level, there should be a high difference in voltage potential between the electrodes 14 and 15. This can be implemented in two ways, but in practice a simple construction is one in which the electrode 14 is connected to a high voltage and the electrode 15 is earthed according to FIG. 3. This electrode can also be left floating, though this may weaken the filtering effect.

Naturally, the positions of the earthed and live electrodes in FIG. 3 can be reversed, i.e. the high voltage can be connected to the electrode 15 while the electrode 14 can be earthed or left to float.

In a solution according to the invention, the component 12 containing the filter material is preferably changeable. Alternatively, the entire collector section 2 can be changeable. The interval between changes depends on the environmental conditions and the airflow. If the solution is being used for filtering the incoming air in an individual room, the changing interval can be in the order of 1000–3000 hours, i.e.

clearly more than one order of magnitude greater than when using the present filters installed in a central air-conditioning machine. As the ventilation is typically used for only part of the day, the change interval will be in the order of 6–12 months. The most expensive part of the solution, i.e. the high-voltage supply and the charger 10 are, on the other hand, permanent, which reduces the filter's operating costs. An examination of the total costs of the filtering shows the costs to be low for the whole service life of the filter.

The solution compactly combines particle and gas filtering. The space required is clearly less than when using separate filters (gas filter+particle filter) of a corresponding capacity. For example, for an airflow of 50 l/s, the space required is in the order of 0.3 m×0.3 m×0.3 m. The external dimensions can be further reduced from even this, with no loss of effectiveness in particle filter, though this will also reduce the capacity of the gas filter (the changing interval will be shortened)

In this invention, materials with a low electrical conductivity are used as the electrodes. This will limit the increase in current in a possible short circuit, so that the filter will still operate even in fault situations in which other electrical filters no longer operate.

MEASUREMENT RESULTS

Figure 4:
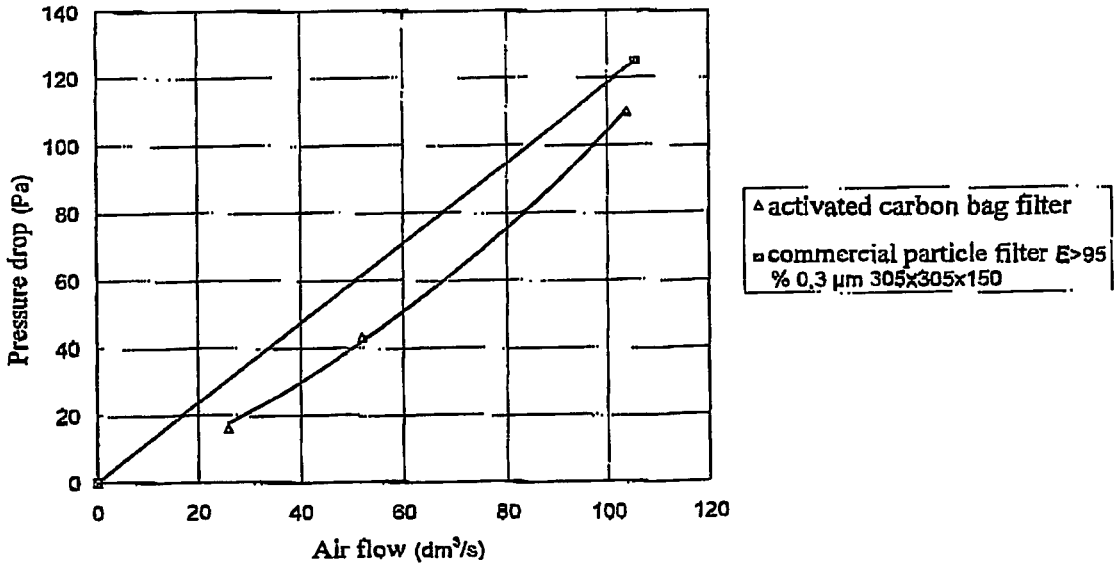
FIG. 4 shows graphically the pressure drops of a particle filter according to the invention and a commercial particle filter.
Figure 5:
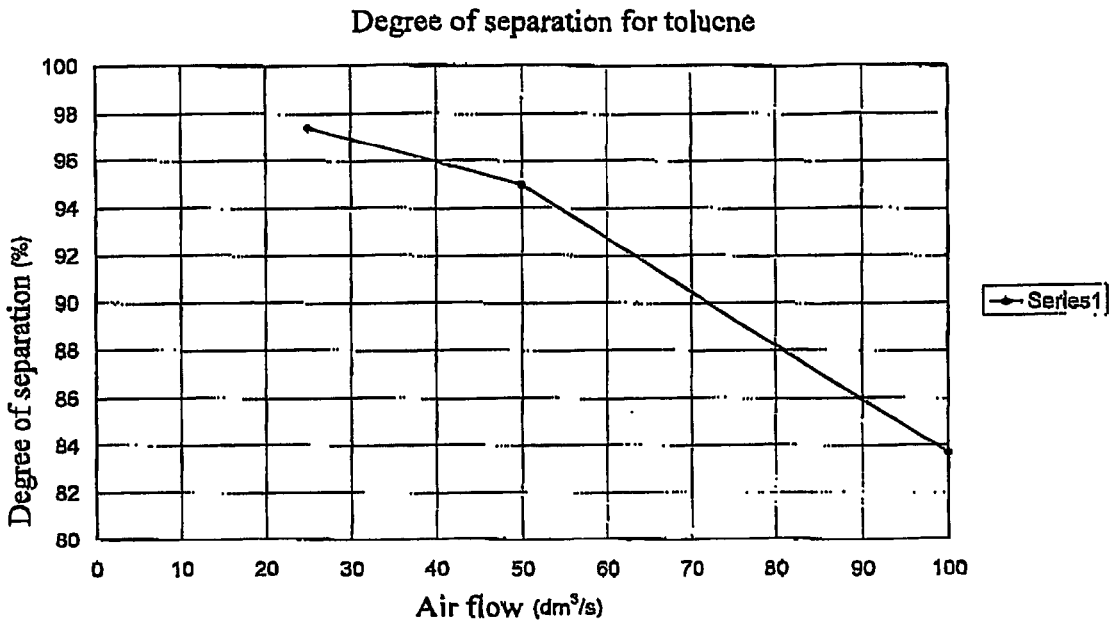
FIG. 5 shows graphically the degree of separation of a filter according to the invention, as a function of the airflow.
Figure 6:
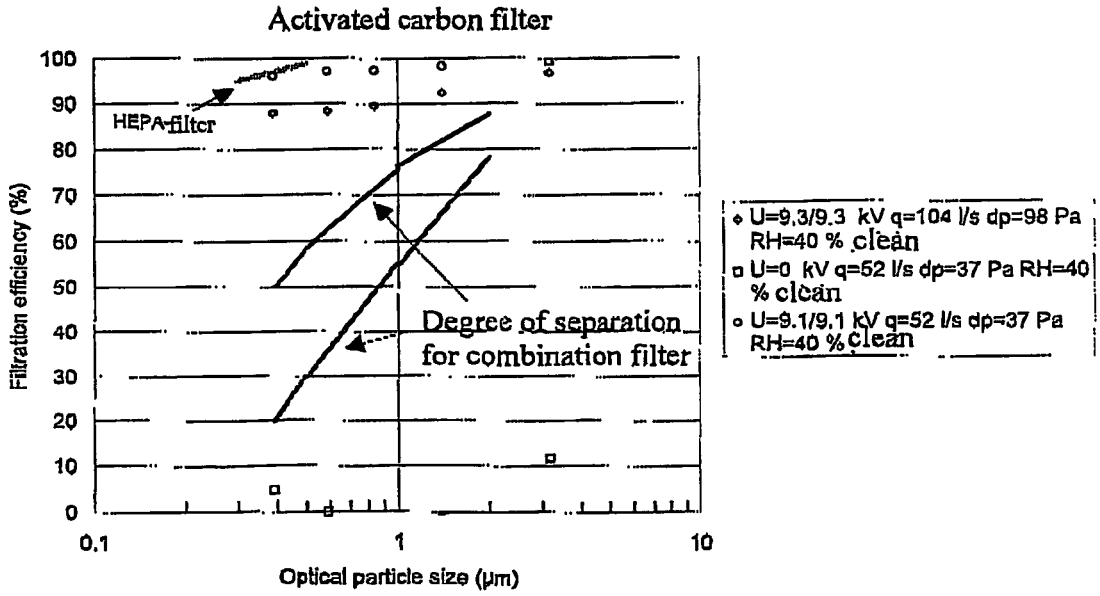
FIG. 6 shows graphically a comparison of the particle separation of the prior art and the invention.
Figure 7:
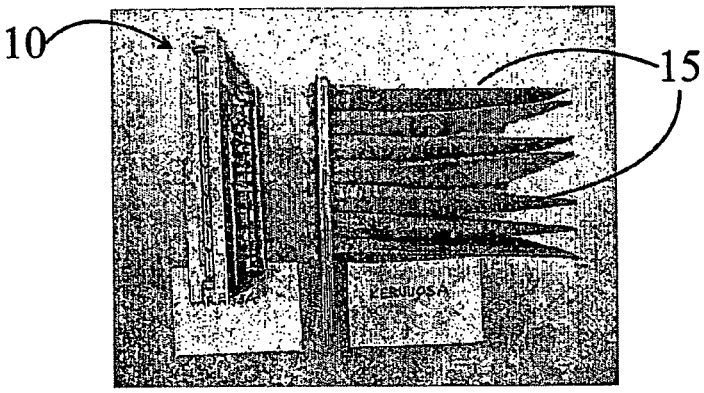
FIG. 7 shows a side view of an electrostatic filter according to the invention.
Figure 8:
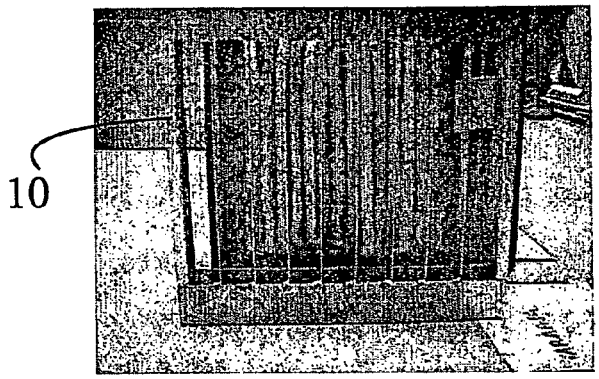
FIG. 8 shows the filter according to FIG. 7, seen from the direction of the air flow.
Figure 9:
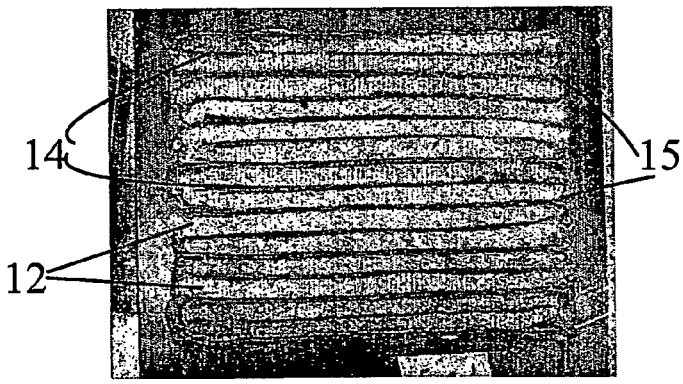
FIG. 9 shows the filter according to FIG. 7, seen from the direction of the air flow and without the charging unit.
Figure 10:
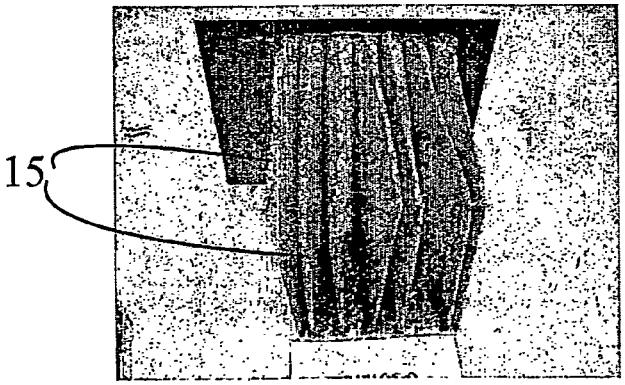
FIG. 10 shows the filter according to FIG. 7, seen from the rear (against the flow of air).

FIGS. 4–6 show the preliminary measurement results of a prototype filter made for the solution. The prototype's external dimensions are in the order of 30 cm×30 cm×30 cm. In the prototype, the properties of the filter have not been optimized, so that it is probable that by selecting the materials and making changes in the construction even better values can be achieved. The results show, however, that even the present level achieves powerful particle and gas filtering with a low pressure drop.

FIG. 4 shows the pressure drops for the present invention and a particle filter of the same size class of a known manufacturer. The particle filter is a HEPA class, with a separation capacity of >95% for 0.3 μm particles, i.e. its filtering capacity is in the same class as that of the invention. The figure shows that even the particle filter by itself has a greater pressure drop than the present invention.

FIG. 5 shows the effectiveness of the prototype filter in filtering a test gas (toluene, generally used as a test gas). The figure shows that as the airflow increases, the permeability increases (the separation efficiency diminishes), but that for an airflow of 50 l/s it is still in the order of 95%. This is the same order as the gas separation efficiencies of the combined gas and particle filters of commercial manufacturers.

FIG. 6 compares the separating capacity of the present invention with that of commercial products. Without electrical forces (U=0 kV), the separation efficiency is extremely modest, but with the aid of particle charging and of an electrical field the separation efficiency increases enormously. The commercial filters have a relatively modest separation efficiency for small particles, whereas a filter equipped with activated-carbon bags will separate more than 95% of 0.3 μm particles, when the airflow is in the order of 50 l/s. It is precisely these small particles that are most hazardous to human health, because they can travel as far as the innermost parts of the lungs.

FIGS. 7–10 show photographs of the construction shown in FIG. 3. The figures shows the bag-likeness of the activated carbon electrodes 15 and the modular construction, which allows the transverse size of the filter to be easily altered by adding more 'bag elements'.

According to the invention, one of the electrodes can be made from an electrically conductive material. In this case, the bag-like electrode can be of a material with a low electrical conductivity.

SUMMARY

With the aid of the present invention, it is possible to filter out the small particles that are most hazardous to human health effectively and economically. In addition, the gas filtering makes it possible to eliminate gases that are hazardous to health, as well as unpleasant odours. By selecting suitable material and impregnation substances the solution can also be used to protect products and devices from corrosion and oxidation.

Thanks to its performance values and simple construction, the solution has a wide range of applications in cleaning air and other gases.

The invention claimed is:

1. A combined gas and electrostatic filter construction, which includes first electrodes, second electrodes, which are electrically insulated from the first electrodes, and an insulating material acting as a particle filter, which is located between the first and the second electrodes, whereby a difference in electrical potential between the electrodes can be created, in order to create an electrical field between the electrodes, characterized in that the material of at least one of the electrodes is a material, comprising activated carbon, which is permeable to air and which filters gases, and which has a low electrical conductivity, both electrodes are set substantially parallel to the direction of the airflow, and the gas filtering electrode is shaped to form a bag.

2. An electrostatic filter construction according to claim 1, characterized in that one electrode with low electrical conductivity is shaped like a bag and particle filtering is arranged inside it with the aid of the filter material and the electrodes.

3. An electrostatic filter construction according to claim 1, characterized in that one of the electrodes has low electrical conductivity and the other is electrically conductive.

4. An electrostatic filter construction according to claim 1, characterized in that one of the electrodes is connected to an earth potential and the other to a higher potential.

5. An electrostatic filter construction according to claim 1, characterized in that one of the electrodes is allowed to float and the other is connected to an earth potential.

6. An electrostatic filter construction according to claim 1, characterized in that the electrodes are arranged in such a way that at least most of the airflow is arranged to travel through the bag-shaped electrode.

7. An electrostatic filter construction according to claim 1, characterized in that a charging section, which charges the particles to be filtered, is arranged before the filter in the path of the air flow.

8. An electrostatic filter construction according to claim 1, characterized in that the filter material is arranged to be changeable.

* * * * *